United States Patent [19]

Swasey et al.

[11] 4,184,824

[45] Jan. 22, 1980

[54] CONTINUOUS SHEETER

[75] Inventors: Archie N. Swasey, Oxford; George P. Grenier, Naugatuck, both of Conn.

[73] Assignee: USM Corporation, Farmington, Conn.

[21] Appl. No.: 909,611

[22] Filed: May 26, 1978

[51] Int. Cl.[2] ..... A01J 21/00

[52] U.S. Cl. ..... 425/75; 425/224

[58] Field of Search ..... 425/73, 224, 75

[56] References Cited

U.S. PATENT DOCUMENTS

| | | | |
|---|---|---|---|
| 2,055,412 | 9/1936 | Hurst et al. | 19/161.1 |
| 3,197,529 | 7/1965 | Greiner | 264/62 |
| 3,770,569 | 11/1973 | Breiner | 428/426 |

*Primary Examiner*—Robert F. White
*Assistant Examiner*—James R. Hall
*Attorney, Agent, or Firm*—Donald N. Halgren; Richard B. Megley; Vincent A. White

[57] ABSTRACT

A machine for the continuous manufacture of a multilayer toxicogenic web material, such as asbestos. The machine includes a series of controlled feed units sequentially arranged above a continuous conveyor belt to serially deposit incremental layers of asbestos and oil products on the conveyor belt to form a thick, continuous sheet which is removed after proper curing, from the downstream end of the conveyor belt by a doctor blade. The machine is housed in an environmentally safe containment enclosure to prevent escape of potentially harmful material therefrom.

16 Claims, 1 Drawing Figure

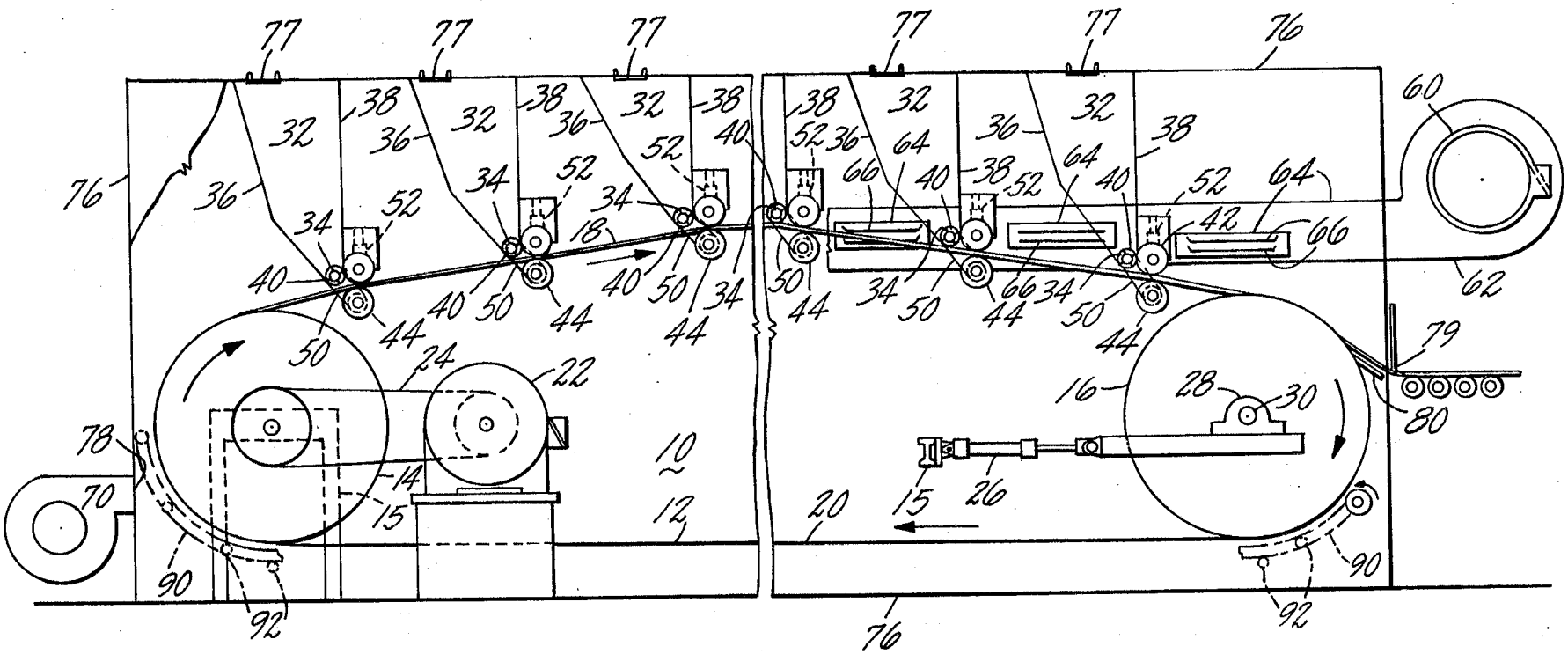

CONTINUOUS SHEETER

BACKGROUND OF THE INVENTION

1. Field of the Invention

This invention relates to process machinery, and more particularly to machinery for the continuous manufacture of a web of multilayer material, such as asbestos.

2. Prior Art

Asbestos sheet is an item necessary for the manufacture of gaskets, brake pads, scuff plates, insulation and the like, all necessary for the functioning of our modern society. This modern society however, has also dictated safety standards for the production of such goods containing asbestos, because of its possible toxicological properties. These properties include the presence of fines and fumes which may be harmful to the operators of the machines which are currently utilized to make asbestos sheet. One of the machines which presently manufacture sheets of asbestos is generally comprised of a large roll onto which the asbestos fiber is fed. After a suitable accretion and curing of the fibers, the machine operator makes an axially directed cut through the build-up of fibers on the roll of the machine. The roll is then turned, and a single sheet is pulled (and scraped) off the roll. This is a time consuming method and involves a potentially dangerous operation because it involves close operator attention and contact, and creates atmospheric fines when the sheet is cut on the roll. Other examples of the prior art manufacture of asbestos sheet or other web material are shown in U.S. Pat. Nos. 3,770,569; 2,055,412; 3,967,043; 3,861,971 and 3,197,529.

BRIEF SUMMARY OF THE INVENTION

The present invention comprises a machine capable of manufacturing a continuous multilayered webbed article, such as a continuous sheet of asbestos. The machine comprises an endless conveyor belt horizontally arranged about a pair of rolls, at least one of which is powered. A plurality of hoppers are sequentially arranged above the top side of the upper run of the conveyor belt. The hoppers are filled from their top portions and discharge the material out an opening in their bottom portion. Each hopper has a rotatable vaned spreader across the opening in its bottom portion. Immediately downstream of each hopper, there is disposed a pair of nip rollers. One roller being arranged beneath the upper run of the conveyor belt, and the other roller being adjustably arranged across the top of the upper run of the conveyor. The nip rollers provide the pressure to any material which is dispersed across the belt from the hoppers. The entire machine is enclosed and is provided with forced hot air within the enclosure at the downstream end of the conveyor belt. The hot air helps process the asbestos sheet during its manufacture. A suction fan is disposed at the upstream end of the conveyor belt, to trap toxic fumes and fines generated during the manufacturing of the asbestos sheet and to recycle those toxic materials within the closed manufacturing system. The webbed material is scraped off the top of the conveyor belt at its downstream end, is passed out a door in the enclosure, onto a line of conveyor rollers, thus providing a continuum of safely manufactured product, which in the preferred embodiment is a continuous sheet of asbestos.

BRIEF DESCRIPTION OF THE DRAWING

The objects and advantages of the present invention will become more apparent when viewed in conjunction with the following drawing in which:

FIG. 1 is a side view of a continuous sheeter machine with portions of its side wall removed for clarity.

DESCRIPTION OF THE PREFERRED EMBODIMENT

Referring now to FIG. 1, there is shown a continuous sheeter machine 10, comprising an endless conveyor belt 12 disposed about a horizontally arranged rotatively disposed drum 14 on a frame portion 15 of the sheeter machine 10 at its upstream end. The conveyor belt 12 is also arranged about a horizontally disposed drum 16 rotatively disposed on the frame 15 at its downstream end of the sheeter machine 10. The conveyor belt 12 has an upper run 18 and a lower run 20, which define the build-up path for the product, and the return path for the unloaded conveyor belt 12, respectively. The upstream drum 14 is rotatively powered by a motor 22 connected therebetween by a drive chain 24. The downstream drum 16 is adjustably arranged on the machine frame 15 by interconnection with a pair of belt tensioning arms 26, only one being shown. Each arm 26 is supported at one end, at the frame 15, and at the other end, to a bearing 28 rotatively supporting a journal 30 on each side of the downstream drum 16. Each arm 26 is longitudinally adjustable to vary the tension in the conveyor belt 12.

A plurality of feed hoppers 32 are sequentially disposed above the upper run 18 of the conveyor belt 12 and in one utilization, may be filled with various toxic or otherwise hazardous feed mixes of asbestos and latex. The feed hoppers 32 each have a generally rectangular opening 34 at their lowermost portions. The openings 34 extend across the width of the conveyor belt 12. The feed hoppers 32 each have an upstream and a downstream wall 36 and 38, slanted so as to permit efficient flow of feed through the openings 34. A spreader 40 is rotatively arranged along the length of the opening 34. The spreader 40 has blades or vanes which aid in the proper mix and distribution rate of the feed material through the opening 34 and onto the conveyor belt 12.

An upper and a lower arrangement of nip rolls 42 and 44 are rotatively disposed immediately downstream of the downstream wall 38 of each feed hopper 32. The upper nip roll 42 is disposed across the top side of the upper run 18, and the lower nip roll 44 is juxtaposed with respect to the upper nip roll 42, across the bottom side of the upper run 18. The upper nip roll 42 may be cooled with a flow of chilled water, down to a temperature of about 45° F., the chilled water entering and leaving the roll 42 through rotary joints, on each end thereof, not shown, by means well known in the art. The lower nip roll 44 may be heated up to a temperature of about 250° F. by steam entering and leaving the roll 44 through a similar arrangement of rotary joints. The lower nip roll 44 may be rotatively connected with the spreader 40 by a chain 50, belt or the like. The connection between the lower nip roll 44 and the spreader 40 maintains the proper speed of rotation of the spreader 40 in relation to the speed of the belt 12 and the nip rolls, 42 and 44. The upper and lower nip rolls 42 and 44, are also rotated by means, not shown, such as by motors or by engagement means with the conveyor belt 12 to maintain their rotative speed to correspond or be compatible with the linear speed of the conveyor belt 12. Each of the upper nip rolls 42 may be adjustable in the heightwise direction by any suitable means such as a regulatable pressurizable cylinder arrangement 52 journalled at each end of the upper nip roll 42. The pressures in the cylinder arrangements 52 may be governed by connection with a proper regulatable pressure source, not shown. The heightwise adjustment of the upper rolls 42 by the pressurizable cylinder arrangements 52 permits variation in/or maintenance of constant accretion in thickness of the accumulating product as it travels downstream on the conveyor belt 12. The pressurizable cylinder arrangements 52 also permit adjustment of the nip pressure which is preferably about 800 lbs. per linear inch of roll length in the application shown but which may be varied to suit the materials being processed.

A forced hot air system 60 may be arranged roughly parallel to the upper run 18 of the conveyor belt 12. The hot air system 60 includes a blower 62 arranged to blow controlled temperature air (which may be heated to a temperature of about 300° F., depending on the material being processed), through a duct network 64, only partially shown, having a plurality of vents 66 that extend partway over the conveyor belt 12 and are adapted to jet the hot air onto the feed material on the conveyor belt 12, between successive arrangements of the nip rolls, 42 and 44. A suction fan 70 is disposed at the upstream end of the sheeter machine 10 to draw off toxic fines and fumes from the feed hoppers 32 and as they are produced from the curing of the feed material on the conveyor belt 12. The entire continuous sheeter machine 10 is disposed in an environmentally safe containment enclosure 76. The enclosure 76 has an exit orifice 78 to permit the suction fan 70 to fully withdraw the toxic vapors and later to filter them, scrub, and prepare them, by means not shown, for recycling which may be within the continuous sheeter machine. The top of the enclosure 76 has a plurality of door means 77 which permit the filling of the hoppers 32 with the necessary feed material. The doors are sealed when closed to prevent contamination of the outside atmosphere during machine operation. The downstream end of the enclosure 76 has a flap door 79 which permits egress of the finished product, asbestos sheet in this case, onto a roller belt, after it is scraped off of the downstream drum 16 by a scraper blade 80.

In operation of the continuous sheeter machine 10 for producing asbestos sheet, the feed hopper 32, as shown to the left on FIG. 1, (the most upstream hopper) is filled through the sealable door means 77 in the top of the enclosure 76, with almost pure latex or uncured rubber. Successive downstream hoppers may be filled through similarly arranged doors 77 with about 15% latex and about 85% asbestos fibers. The last most downstream hopper would be filled with almost pure latex. Materials such as ground ceramic particles, e.g. silica, calcium carbonate, or clays such as alumina, barium sulfate, may be mixed with or substituted for the asbestos fibers, and plastics such as PVC may be used in place of latex to manufacture other continuous sheets of gasket-like material on the present invention. This premix of fibers and rubber compounds, or their substitutes, are deposited and built-up on the conveyor belt 12, during machine operation, by about 0.003"–0.006" of material, from each successive hopper 32. The mix of material is heated by the jets of hot air coming from the duct network 64 arranged between successive arrangements of nip rolls, 40 and 42. The hot air keeps the asbestos mix hot and workable. The upper rollers 40 are cooled during the manufacturing operation to prevent the asbestos sheet from sticking to them.

The suction fan 70 draws off the vapor solvents from the operation, and carries those vapors such as naphtha, toluene and the like, to a filter bed, not shown, and to scrubbers, also not shown, where the vapors are condensed for reuse. The complete enclosure 76 confines these vapors and permits the manufacture of continuous sheets of asbestos or other material without substantially exposing operators to potentially hazardous conditions.

An alternative embodiment of the present invention includes a hugger belt 90 with an arrangement of rotatable support rollers 92 which support the hugger belt along the bottom side of the lower run 20 of the conveyor belt 12. The hugger belt 90 may be used to bring a length of asbestos sheet around the conveyor belt 12 additional times to incrementally build up its thickness as it passes beneath the hoppers 32 and receives their discharge before being scraped off by the scraper blade 80.

Though the invention has been described with a degree of particularity, it is intended that the appended claims be interpreted as exemplary only, and not in a limiting sense.

We claim:

1. A machine for the continuous manufacture of sheet material such as asbestos from a collection of its constituent materials, said machine comprising:

a generally horizontally arranged conveyor apparatus including an upstream rotatively empowered drum, and a transversely adjustable rotatable downstream drum, having a conveyor belt extending therearound;

a plurality of feed hoppers each for containing a portion of the constituent materials used in the manufacture of said sheet, said hoppers being sequentially arranged along the top side of said conveyor belt;

an arrangement of pressure rollers immediately downstream of each of said feed hoppers, at least a first one of said rollers being disposed above said conveyor belt, and at least a second one of said rollers being juxtaposed therewith on the opposite side of said conveyor belt; and an enclosure surrounding said machine for maintaining an environmentally safe manufacturing operation.

2. A machine for the continuous manufacture of sheet material as recited in claim 1 wherein said machine includes a forced hot air system which jets hot air onto said conveyor belt.

3. A machine for the continuous manufacture of sheet material as recited in claim 1 wherein each of said first rollers is transversely displaceable to permit modification of the pressure and distance between said first roller and said second roller.

4. A machine for the continuous manufacture of sheet material as recited in claim 1, wherein at least one of said pressure rollers has a heat transfer arrangement adapted thereto.

5. A machine for the continuous manufacture of sheet material as recited in claim 1, wherein each of said feed hoppers has an opening across its lowermost portion thereof, and a spreader is rotatably supported there-along for proper distribution of the constituent materials across said conveyor belt.

6. A machine for the continuous manufacture of sheet material as recited in claim 1, wherein said machine includes a suction fan apparatus arranged through said enclosure to remove vapors and other loose material from the constituent materials within said enclosure for later reclaiming and recycling.

7. A machine for the continuous manufacture of sheet material as recited in claim 1, wherein said upstream drum has a heat transfer arrangement adapted thereto for controlling the temperature of said conveyor belt.

8. A machine for the continuous manufacture of sheet material as recited in claim 1, wherein said conveyor belt has a lower run having a hugger belt generally parallel thereto, to permit said sheet material to be recycled beneath said hoppers for further accretion of constituent material, by having said sheet material being held against said lower run of said conveyor belt.

9. A machine for the continuous manufacture of sheet material as recited in claim 1 wherein said enclosure has a biased door which permits snug egress of said sheet material therethrough.

10. A machine for the continuous manufacture of sheet material as recited in claim 3, wherein said first roller has an arrangement of regulatable pressurizable cylinders journalled therewith to effect said transverse displacement thereof.

11. A machine for the continuous manufacture of sheet material as recited in claim 5, wherein said spreader is in rotative engagement with one of said pressure rollers, and at least one of said pressure rollers is in synchronous rotation with the speed of movement of said conveyor belt.

12. A machine for the continuous manufacture of sheet material as recited in claim 9, wherein said enclosure has means for permitting the loading of said feed hoppers with constituent material which will comprise said sheet material.

13. A machine for the continuous manufacture of sheet material as recited in claim 9 wherein said means for permitting the loading of said feed hoppers comprises a plurality of doors which are openable and sealingly closeable to prevent environmental contamination of the atmosphere by any vapors of said constituent material.

14. A machine for the continuous manufacture of sheet material as recited in claim 10 wherein said first roller has a cooling system adapted therewith to prevent the hot constituent materials from sticking thereto.

15. A machine for the continuous manufacture of sheet material as recited in claim 11, wherein said spreader is in synchronization with said second roller.

16. A machine for the continuous manufacture of sheet material as recited in claim 15, wherein said second roller has a heating system adapted therewith to maintain the temperature of said conveyor belt to permit proper working and curing of the sheet material thereon.

* * * * *